US005336582A

United States Patent [19]

Takegawa et al.

[11] Patent Number: 5,336,582

[45] Date of Patent: Aug. 9, 1994

[54] ELECTROPHOTOGRAPHIC IMAGE FORMATION COMPRISING AN ARYLAMINE IN A CHARGE TRANSPORT LAYER AND AN ENCAPSULATED TONER

[75] Inventors: Ichiro Takegawa; Tsutomu Kubo, both of Minami-ashigara; Keiko Ariie, Yokohama; Tomoo Kobayashi, Minami-ashigara, all of Japan

[73] Assignee: Fuji Xerox Co., Ltd., Tokyo, Japan

[21] Appl. No.: 928,316

[22] Filed: Aug. 12, 1992

[30] Foreign Application Priority Data

Aug. 13, 1991 [JP] Japan ..... 3-226334

[51] Int. Cl.[5] ..... G03G 9/08

[52] U.S. Cl. ..... 430/120; 430/138; 430/110; 430/98; 430/57; 430/58; 430/59; 430/72

[58] Field of Search ..... 430/110, 120, 138, 56, 430/57, 72, 98, 58, 59

[56] References Cited

U.S. PATENT DOCUMENTS 4,933,249 6/1990 Mikami ..... 430/110

*Primary Examiner*—Steve Rosasco

*Attorney, Agent, or Firm*—Oliff & Berridge

[57] ABSTRACT

An electrophotographic method for image formation comprising forming an electrostatic latent image on an electrophotographic photoreceptor comprising a conductive substrate having formed thereon a photosensitive layer containing a high polymeric arylamine compound represented by formula (I):

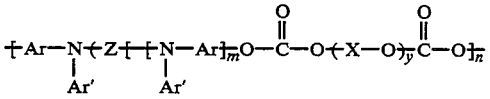

(I)

wherein n represents an integer of from 5 to 5000; m represents 0 or 1; y represents 1, 2, or 3; Ar represents

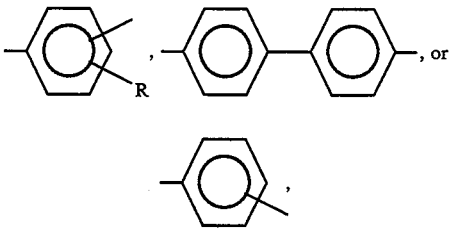

wherein R represents a methyl group, an ethyl group, a propyl group, or a butyl group; Ar′ represents

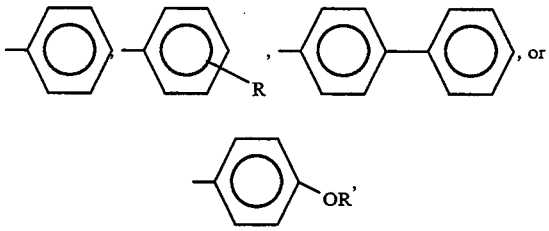

wherein R is as defined above; X represents an alkylene or isoalkylene group having from 2 to 10 carbon atoms; and Z represents

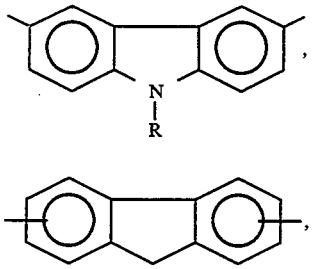

(Abstract continued on next page.)

-continued

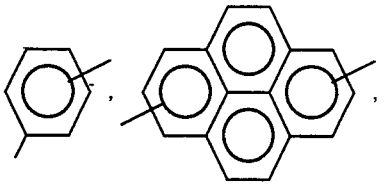

or —Ar—$(W)_k$—Ar—, wherein Ar is as defined above; W represents —$CH_2$—, —$C(CH_3)_2$—, —O—, —S—,

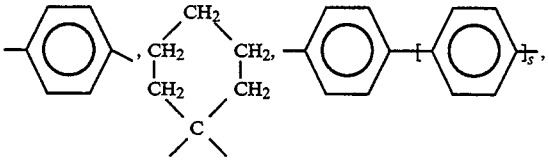

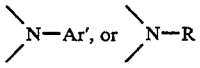

(wherein s represents 0, 1, or 2; and R and Ar′ are as defined above); and k represents 0 or 1, developing the latent image with a microcapsule toner containing in its core at least a polymer dispersed in a solvent, and transferring the toner image to paper. Copies of satisfactory image quality can be obtained in a stable manner for an extended period of time without being accompanied by the phenomenon of copy image disappearance.

4 Claims, No Drawings

ELECTROPHOTOGRAPHIC IMAGE FORMATION COMPRISING AN ARYLAMINE IN A CHARGE TRANSPORT LAYER AND AN ENCAPSULATED TONER

FIELD OF THE INVENTION

This invention relates to a method of electrophotographic image formation using an electrophotographic photoreceptor containing a high polymeric compound as a charge transporting material and a capsule toner as a developer.

BACKGROUND OF THE INVENTION

In recent years, electrophotographic photoreceptors have been markedly extending their use in electrophotographic apparatus, such as copying machines, laser beam printers, etc. because of their high-speed and high quality printing performance. Studies have been elaborated on electrophotographic photoreceptors using an organic photoconductive material (hereinafter simply referred to as an organic photoreceptor) for use in these electrophotographic apparatus in view of their advantages in price, productivity, and disposability over those using an inorganic photoconductive material, such as selenium, selenium-tellurium alloys, selenium-arsenic alloys, and cadmium sulfide. In particular, so-called separate function type organic photoreceptors comprising a charge generating layer and a charge transporting layer are excellent in electrophotographic characteristics, such as sensitivity, chargeability, and stability on repeated use, and various proposals on this type of photoreceptors have been made to date, some of which have already been put to practical use. For example, U.S. Pat. No. 4,806,443 discloses a photoreceptor using an arylamine compound as a charge transporting material.

On the other hand, while a development system includes one-component development system and a two-component development system, an electrophotographic system using a microcapsule toner has been studied, in which image fixing is effected by pressure application instead of heat application so as to eliminate excessive energy imposed on the apparatus.

In order to obtain a capsule toner having sufficient pressure fixing properties while maintaining developability (i.e., chargeability), it is necessary to form a capsule structure composed of a core containing an ink comprising a solvent having dispersed therein a pigment and a binder and an outer shell having a charge control function as suggested in JP-A-51-132838, JP-A-58-145964, and JP-A-60-83958 (the term "JP-A" as used herein means an "unexamined published Japanese patent application").

Where a capsule toner having such a structure is used in combination with an organic photoreceptor, a part of a charge control agent present on the shell surface becomes liable to adhere to the organic photoreceptor during long-term use. The adhered substance undergoes denaturation by ozone generated in the copying machine and is rendered electrically conductive. This leads to trouble that the charge of an electrostatic latent image on the photoreceptor is leaked, that is, the image disappears. For this reason, it has been difficult to use a capsule toner in combination with an organic photoreceptor.

SUMMARY OF THE INVENTION

An object of the present invention is to provide an electrophotographic method for image formation by using an organic photoreceptor and a microcapsule toner, which makes it possible to form a high quality image without involving the trouble of image disappearance on long-term use.

The inventors have conducted extensive investigations on various organic photosensitive materials in seeking for an organic photoreceptor which can be conjoined with a microcapsule toner without causing the above-described problem. As a result, it has now been found that a charge control agent which is present on the capsule shell of the toner for imparting a charge control function can be made less adhesive to an organic photoreceptor by using a high polymeric compound represented by formula (I) shown below as a charge transporting material. The present invention has been completed based on this finding.

The present invention relates to an electrophotographic method for image formation comprising forming an electrostatic latent image on an electrophotographic photoreceptor comprising a conductive substrate having formed thereon a photosensitive layer containing a high polymeric arylamine compound represented by formula (I):

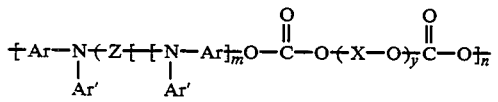

(I)

wherein n represents an integer of from 5 to 5000; m represents 0 or 1; y represents 1, 2, or 3; Ar represents

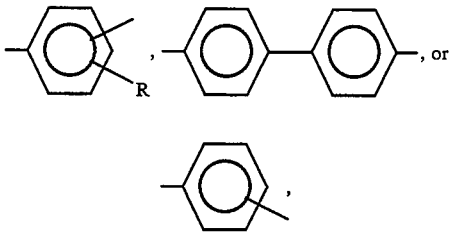

wherein R represents a methyl group, an ethyl group, a propyl group, or a butyl group; Ar' represents

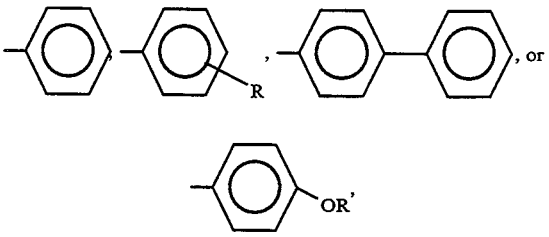

wherein R is as defined above; X represents an alkylene or isoalkylene group having from 2 to 10 carbon atoms; and Z represents

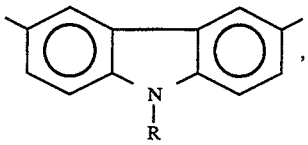

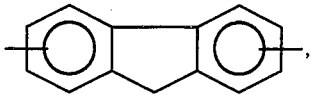

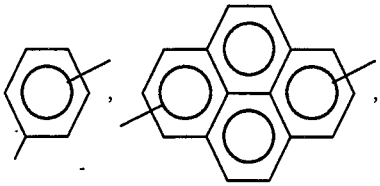

or —Ar—$(W)_k$—Ar—, wherein Ar is as defined above; W represents —$CH_2$—, —$C(CH_3)_2$—, —O—, —S—,

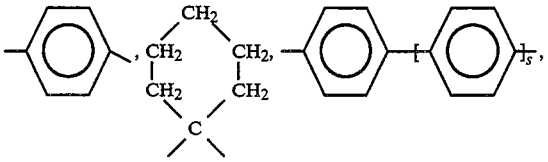

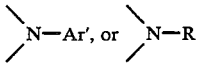

(wherein s represents 0, 1, or 2; and R and Ar' are as defined above); and k represents 0 or 1.

DETAILED DESCRIPTION OF THE INVENTION

Known conductive substrate may be used in the electrophotographic photoreceptor which can be used in the present invention. Suitable conductive substrates include metallic drums or sheets made of aluminum, copper, iron, zinc, nickel, etc.; and drums, sheets or plates made of paper, synthetic resins or glass, the surface of which is rendered electrically conductive by gaseous phase deposition, such as vacuum evaporation or sputtering, of a metal (e.g., aluminum, copper, gold, silver, platinum, palladium, titanium, nickel-chromium, stainless steel, or copper-indium) or a conductive metallic compound (e.g., indium oxide or tin oxide), by lamination of a metallic foil, or by coating of conductive particles (e.g., carbon black, indium oxide, tin oxide-antimony oxide, titanium oxide, metallic powder, or copper iodide) dispersed in a binder resin.

If desired, the conductive substrate may be subjected to various surface treatments for the purpose of preventing white pepper, black pepper, or an interference band on exposure to laser light. Such surface treatments include anodizing, chemical oxidation, etching, coloring, and graining (surface toughening), e.g., sandblasting, liquid honing, bite cutting, or buffing.

If desired, the conductive substrate may have thereon a subbing layer having a barrier function or an adhesive function. Usable materials for the subbing layer include resins, such as polyvinyl butyral, polyvinyl formal, polyvinyl alcohol, casein, polyamide, cellulose, gelatin, polyurethane, and polyester, and metal oxides, such as aluminum oxide.

The photosensitive layer formed on the conductive substrate is composed of a charge generating layer and a charge transporting layer. The charge generating layer can be formed by vacuum deposition of a charge generating material or by coating a composition containing a charge generating material, an organic solvent, and a binder resin.

Suitable charge generating materials include inorganic photoconductors, such as amorphous selenium, crystalline selenium (e.g., trigonal selenium), selenium-tellurium alloys, selenium-arsenic alloys, and other selenium compounds or alloys, amorphous silicon, zinc oxide, and titanium oxide; and organic pigments or dyes, such as phthalocyanine pigments, squarylium pigments, anthanthrone pigments, perylene pigments, azo pigments, anthraquinone pigments, pyrene pigments, pyrylium salts, and thiapyrylium salts.

Suitable binder resins to be used for dispersing a charge generating material include polycarbonate resins of bisphenol A type or bisphenol Z type, butyral resins, polyester resins, phenoxy resins, methacrylic resins, acrylic resins, polyvinyl chloride resins, polystyrene resins, polyvinyl acetate resins, styrene-butadiene copolymer resins, vinylidene chloride-acrylonitrile copolylmer resins, vinyl chloride-vinyl acetate-maleic anhydride copolymer resins, silicone resins, silicone-alkyd resins, phenol-formaldehyde resins, styrene-alkyd resins, and poly-N-vinylcarbazole. These binder resins may be used either individually or in combination of two or more thereof.

A weight ratio of a charge generating material to a binder resin preferably ranges from 20:1 to 1:10, and more preferably from 10:1 to 3:7.

The charge generating layer usually has a thickness of from 0.01 to 5 μm, and preferably of from 0.05 to 2.0 μm.

A pigment dispersion to be coated may be prepared by dissolving a binder resin in an organic solvent, adding a pigment to the solution, and dispersing the mixture in a paint shaker, a ball mill, a sand grind mill, an attritor, etc.

Suitable organic solvents for the charge generating layer include hydrocarbons, e.g., hexane, benzene, toluene, and xylene; halogenated hydrocarbons, e.g., methylene chloride, 1,2-dichloroethane, 1,1,2-trichloroethane, and tetrachloroethane; ketones, e.g., acetone, methyl ethyl ketone, and cyclohexanone; esters, e.g., ethyl acetate, butyl acetate, and amyl acetate; alcohols or derivatives thereof, e.g., methanol, ethanol, propanol, butanol, cyclohexanol, pentanol, ethylene glycol, methyl cellosolve, ethyl cellosolve, and cellosolve acetate; ethers, e.g., tetrahydrofuran, 1,4-dioxane, furan, and furfural; acetals, pyridine, and amines. These solvents may be used either individually or in combination of two or more thereof.

Coating of the dispersion can be carried out by dip coating, ring coating, spray coating, spin coating, bead coating, blade coating, roller coating, curtain coating, or the like technique. Drying after coating is preferably carried out first by drying to the touch and then heating usually at a temperature of from 30° to 200° C. for a period of from 5 minutes to 2 hours either in still air or in an air flow.

The charge transporting layer contains a high polymeric arylamine compound represented by formula (I) as a high polymeric charge transporting material. The high polymeric arylamine compound preferably has a molecular weight of from 5,000 to 750,000, and particularly of from 50,000 to 500,000.

Specific examples of the high polymeric charge transporting materials represented by formula (I) are shown below.

Compound 1:

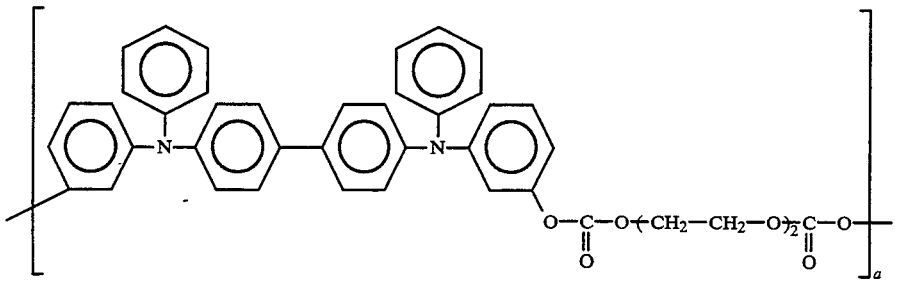

Compound 2:

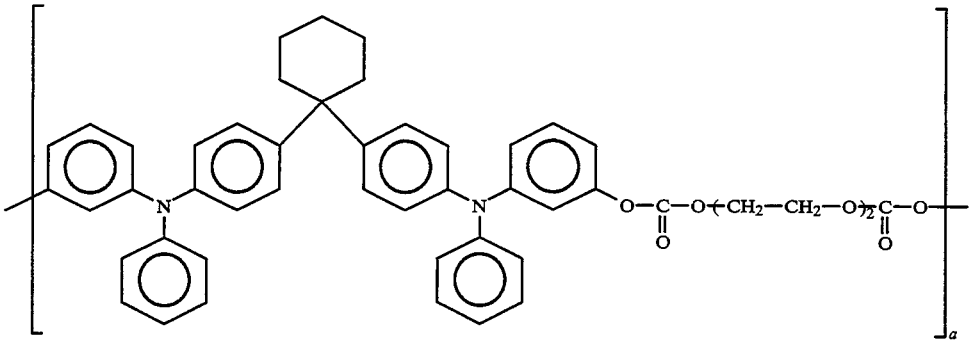

Compound 3:

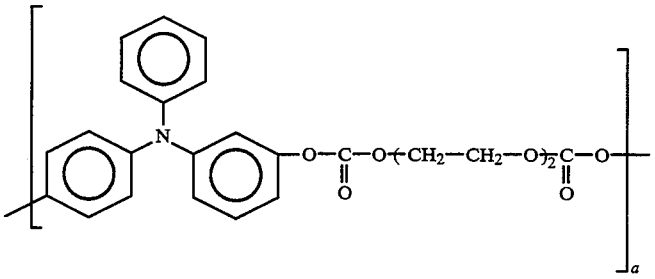

In the above formulae, a represents a number between 10 and 1000.

While the high polymeric arylamine compound of formula (I) is capable of forming a charge transporting layer by itself, it may be used in combination with a binder resin to have increased mechanical strength. The binder resin is generally added in an amount of not more than 50% by weight, preferably 30% by weight or less, based on the amount of the high polymeric arylamine compound.

Examples of suitable binder resins which may be used in the charge transporting layer include insulating resins, such as acrylic resins, polyarylate resins, polyester resins, bisphenol A type or bisphenol Z type polycarbonate resins, polystyrene resins, acrylonitrile-styrene copolymer resins, acrylonitrile-butadiene copolymer resins, polyvinyl butyral resins, polyvinyl formal resins, polysulfone resins, polyacrylamide resins, polyamide resins, and chlorinated rubbers.

The charge transporting layer can be formed by coating a solution containing the above-mentioned charge transporting high polymer and a binder resin in an appropriate solvent, followed by drying. Examples of suitable solvents include aromatic hydrocarbons, e.g., benzene, toluene, and chlorobenzene; ketones, e.g., acetone and 2-butanone; halogenated aliphatic hydrocarbons, e.g., methylene chloride, chloroform, and ethylene chloride; cyclic or acyclic ethers, e.g., tetrahydrofuran, dioxane, ethylene glycol, and diethyl ether; and mixtures thereof. The charge transporting layer usually has a thickness of from 5 to 50 μm, and preferably of from 10 to 40 μm.

For the purpose of stabilizing the photoreceptor against ozone or oxidizing gases generated in electrophotographic apparatus, light, or heat, stabilizers such as antioxidants, photostabilizers and heat stabilizers may be incorporated into the photosensitive layer. Examples of usable antioxidants are hindered phenols, hindered amines, p-phenylenediamine, arylalkanes, hydroquinone, spirochroman, spiroindanone, and derivatives thereof; organic sulfur compounds, and organic phosphorus compounds. Examples of usable photostabilizers include derivatives of benzophenone, benzotriazole, dithiocarbamates, or tetramethylpiperidine.

The charge transporting material used in the present invention is a high polymeric compound having film-forming properties. Therefore, it is prevented from being precipitated or crystallized-even when contacted with a solvent in a capsule toner, which is likely to occur in the case of a conventional charge transporting layer containing a low-molecular weight charge transporting material dissolved in a binder resin. Accordingly, it is preferable in the present invention that the charge transporting layer containing such a high polymeric charge transporting material be formed as a surface layer of the photoreceptor.

In the present invention, an electrostatic latent image formed on the photoreceptor in a usual manner is developed with a microcapsule toner in a one-component developing apparatus, and the thus visualized image is then transferred to copying paper and fixed thereon.

The microcapsule toner which can be used in the present invention is not particularly limited as long as it has a capsule structure composed of a core material and an outer shell material covering the core material and has on the outer surface thereof a charge control agent. It is preferable that the core material contains at least a polymer dispersed in a solvent and that the outer shell material comprises a polyurea resin and/or a polyurethane resin, or an epoxyurea resin and/or an epoxyurethane resin. It is also preferable to add external additives to the toner surface.

A colorant maybe contained in the core material comprising a solvent having a polymer dispersed therein, or the outer shell material and preferably in the core material.

Suitable colorants include inorganic pigments, such as carbon black, red oxide, Prussian blue, and titanium oxide; azo pigments, such as Fast Yellow, Disazo Yellow, Pyrazolone Red, Chelate Red, Brilliant Carmine, and Para Brown; phthalocyanine pigments, such as copper phthalocyanine and metal-free phthalocyanine; and condensed polycyclic pigments, such as Flavanthrone Yellow, Dibromoanthrone Orange, Perylene Red, Quinacridone Red, and Dioxazine Violet. Disperse dyes and oil-soluble dyes may also be employed. Further, a part of or the whole of a black colorant may be replaced with a magnetic powder to provide a magnetic one-component toner. Usable magnetic powders include magnetite, ferrite, and single metals (e.g., cobalt, iron, nickel) or alloys thereof.

The polymer to be incorporated into a core material includes known fixable resins. Specific examples of the fixable resins include acrylic ester polymers, such as polymethyl acrylate, polyethyl acrylate, polybutyl acrylate, poly-2-ethylhexyl acrylate, and polylauryl acrylate; methacrylic ester polymers, such as polymethyl methacrylate, polybutyl methacrylate, polyhexyl methacrylate, poly-2-ethylhexyl methacrylate, and polylauryl methacrylate; copolymers of a styrene monomer and an acrylic or methacrylic ester; vinyl polymers, such as polyvinyl acetate, polyvinyl propionate, and polyvinyl butyrate; polyolefins, such as polyethylene, polypropylene, or copolymers thereof; styrene copolymers, such as a styrene-butadiene copolymer, a styrene-isoprene copolymer, and a styrene-maleic acid copolymer; polyvinyl ether, polyvinyl ketone, polyester, polyamide, polyurethane, rubbers, epoxy resins, polyvinyl butyral, rosin, modified rosin, terpene resins, and phenol resins. These polymers may be used either individually or in combination thereof. The polymer may be prepared in situ by charging a monomer(s) and, after encapsulation, polymerizing the monomer(s).

While the polymer is incorporated into a core material in the form of a dispersion or a solution in a solvent, it is necessary for obtaining excellent pressure fixing properties to use a solvent capable of dissolving or swelling the polymer. Such a solvent includes oily solvents having a boiling point of 140° C. or higher, and preferably 160° C. or higher. The solvent to be used may be chosen from, e.g., those described in *Modern Plastics Encyclopedia,* "Plasticizers" (1975–1976). The solvent may also be chosen from among those known as a core material of pressure-fixable capsule toners disclosed, for example, in JP-A-58-145964 and JP-A-63-163373. Specific examples of preferred solvents are phthalic esters (e.g., diethyl phthalate, dibutyl phthalate), aliphatic dicarboxylic esters (e.g., diethyl malonate, dimethyl oxalate), phosphoric esters (e.g., tricresyl phosphate, trixylyl phosphate), citric esters (e.g., o-acetyltriethyl citrate), benzoic esters (e.g., butyl benzoate, hexyl benzoate), fatty acid esters (e.g., hexadecyl myristate, dioctyl adipate), alkylnaphthalenes (e.g., methylnaphthalene, dimethylnaphthalene, monoisopropylnaphthalene, diisopropylnaphthalene), alkyldiphenyl ethers (e.g., o-, m- or p-methyldiphenyl ether), higher fatty acid amides or aromatic sulfonic acid amides (e.g., N,N-dimethyllauramide, N-butylbenzenesulfonamide), trimellitic esters (e.g., trioctyl trimellitate), diarylalkanes (e.g., diarylmethanes, e.g., dimethylphenylphenylmethane; diarylethanes, e.g., 1-phenyl-1-methylphenylethane, 1-dimethylphenyl-1-phenylethane, 1-ethylphenyl-1-phenylethane), and chlorinated paraffins.

For the purpose of improving fixing properties, the core material may further contain additives, such as waxes and silicone oils. Suitable waxes include natural waxes, such as paraffin wax, microcrystalline wax, montan wax, carnauba wax, candelilla wax, and bees wax; and synthetic waxes, such as polyethylene wax, modified wax, cetyl alcohol, and stearic acid.

The outer shell of the capsule toner preferably comprises a polyurea resin, a polyurethane resin, a polyamide resin, a polyester resin, an epoxy resin, an epoxyurea resin, an epoxyurethane resin, or a mixture thereof. More preferably, the outer shell comprises a polyurea resin alone, a polyurethane resin alone, a mixture of a polyurea resin and a polyurethane resin, an epoxyurea resin alone, an epoxyurethane resin alone, or a mixture of an epoxyurea resin and an epoxyurethane resin.

The microcapsule toner can be prepared by any of known encapsulation techniques. Taking covering power and mechanical strength of the outer shell into consideration, encapsulation by interfacial polymerization is advantageous. Encapsulation by interfacial polymerization is described, e.g., in JP-A-57-179860, JP-A-58-66948, JP-A-59-148066, and JP-A-59-162562. For instance, an ink (a dispersion of a colorant, a binder resin, and a solvent capable of dissolving or swelling the binder resin) is thoroughly mixed with a polyisocyanate compound, and the ink is slowly added to a cool solution of hydroxypropylmethyl cellulose (protective colloid) in deionized water, followed by stirring in an emulsifier to prepare an oil-in-water emulsion of oil droplets having an average particle size of about 12 μm. A diethylenetriamine aqueous solution is then added dropwise to the emulsion to conduct a reaction to form an outer shell comprising a polyurethane resin.

It is essential in the present invention that a charge control agent should be present on the surface of the capsule outer shell. The charge control agent may be made to be present either by directly bonding it to the outer shell material by, for example, graft polymerization, or by coating it on the surface of the outer shell.

In the case of negatively chargeable toners, an example of the charge control agent directly bonded to the surface of the outer shell is a polymer containing at least a monomer unit derived from a fluorine-containing vinyl monomer represented by formula (II):

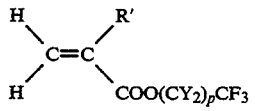

(II)

wherein Y represents a hydrogen atom or a fluorine atom; R′ represents a hydrogen atom or an alkyl group having from 1 to 3 carbon atoms; and p represents an integer of from 1 to 7, adhered onto the outer shell.

Specific examples of the monomers represented by formula (II) are trifluoroethyl acrylate, trifluoroethyl methacrylate, pentafluoropropyl acrylate, pentafluoropropyl methacrylate, trifluoropropyl acrylate, trifluoropropyl methacrylate, trifluorobutyl acrylate, trifluorobutyl methacrylate, trifluoropentyl acrylate, trifluoropentyl methacrylate, pentafluorohexyl acrylate, pentafluorohexyl methacrylate, trifluorohexyl acrylate, trifluorohexyl methacrylate, and pentafluorooctyl methacrylate, with trifluoroethyl acrylate and trifluoroethyl methacrylate being preferred.

The polymer containing a monomer unit derived from the fluorine-containing vinyl monomer represented by formula (II) may be either a homopolymer of the monomer of formula (II) or a copolymer of the monomer of formula (II) and other copolymerizable monomer(s). The content of the monomer of formula (II) in the copolymer is preferably at least 5 mol %, and more preferably at least 10 mol %. If it is less than 5 mol %, independence of chargeability on surroundings would be reduced. Examples of copolymerizable monomers include acrylic or methacrylic (hereafter collectively referred to as "(meth)acrylic") acid; (meth)acrylic esters, such as methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate, and phenyl (meth)acrylate; vinyl-containing carboxylic acids, such as vinylacetic acid, vinylpropionic acid, and vinylbenzoic acid; vinyl-containing cyano compounds, such as acrylonitrile, methacrylonitrile, and cyanostyrene; fatty acid vinyl esters, such as vinyl formate, vinyl acetate, vinyl propionate, vinyl butyrate, vinyl trimethylacetate, vinyl caproate, vinyl caprylate, and vinyl stearate; vinyl ethers, such as ethyl vinyl ether, propyl vinyl ether, butyl vinyl ether, hexyl vinyl ether, 2-ethylhexyl vinyl ether, and phenyl vinyl ether; vinyl ketones, such as methyl vinyl ketone and phenyl vinyl ketone; and vinyl aromatic compounds, such as styrene, chlorostyrene, hydroxystyrene, and α-methylstyrene. These comonomers may be used either individually or in combination of two or more thereof.

In the case of positively chargeable toners, the charge control agent directly bonded to the surface of the outer shell includes acrylic acid compounds having an amino group as described in JP-A-51-132838, quaternary ammonium salt polymers as described in JP-A-59-185353 and JP-A-59-187357, and such quaternary ammonium salt polymers with a halide ion thereof being displaced with another anion.

Monomers constituting the quaternary ammonium salt polymers include vinyl monomers having quaternary nitrogen with a halide ion as an anion, such as (meth)acrylic ester type ammonium salts, e.g., acryloyloxyethyltrimethylammonium chloride, acryloyloxyethyltriethylammonium chloride, methacryloyloxyethyltrimethylammonium chloride, methacryloyloxyethyltriethylammonium chloride, and methacryloyloxyethylbenzylammonium chloride; (meth)acrylamide type ammonium salts, e.g., acrylamidetrimethylpropylammonium chloride, acrylamidetriethylpropylammonium chloride, methacrylamidetrimethylpropylammonium chloride, and methacrylamidebenzylpropylammonium chloride; vinylbenzyl type ammonium salts, e.g., vinylbenzylethylammonium chloride and vinylbenzyltrimethylammonium chloride; vinylpyridinium salts, e.g., N-butylvinylpyridinium bromide and N-cetylvinylpyridinium chloride; and vinylimidazolinium salts, e.g., N-vinyl-2-methylimidazolinium chloride and N-vinyl-2,3dimethylimidazolinium chloride.

The above-mentioned quaternary nitrogen-containing vinyl monomers may be copolymerized with one or more other copolymerizable monomers. Examples of usable copolymerizable monomers include (meth)acrylic acid; (meth)acrylic esters, such as methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate, and phenyl (meth)acrylate; fatty acid vinyl esters, such as vinyl formate, vinyl acetate, vinyl propionate, vinyl butyrate, vinyl trimethylacetate, vinyl caproate, vinyl caprylate, and vinyl stearate; vinyl ethers, such as ethyl vinyl ether, propyl vinyl ether, butyl vinyl ether, hexyl vinyl ether, 2-ethylhexyl vinyl ether, and phenyl vinyl ether; vinyl ketones, such as methyl vinyl ketone and phenyl vinyl ketone; and vinyl aromatic compounds, such as styrene, chlorostyrene, hydroxystyrene, and α-methylstyrene.

After bonding the halogenated ammonium salt monomer to the capsule surface, the halide ion may be substituted by another anion by ion exchanging. Examples of substitutive anions include anion residues of aliphatic or aromatic carboxylic acids, e.g., $CH_3CO_2^-$, $CH_3CH_2CO_2^-$, $CH_3CH_2CH_2CO_2^-$, $CH_3(CH_2)_6CO_2^-$, and $CH_3(CH_2)_{10}CO_2^-$; anion residues of aliphatic or aromatic sulfonic acids, e.g., $CH_3SO_3^-$, $CH_3CH_2SO_3^-$, $CH_3CH_2CH_2SO_3^-$, $CH_3(CH_2)_6SO_3^-$, and $CH_3(CH_2)_{10}SO_3^-$; and anion residues of acid dyes, such as Acid Red, Acid Orange, Acid Violet, and Acid Blue.

If desired, an external additive, such as silicon oxide, aluminum oxide, titanium oxide, or carbon black, may be added to the microcapsule toner for imparting fluidity. The external additive may be adhered to the toner surface by dry blending with a dried microcapsule toner in a twin-cylinder blender, a Henschel mixer, or a like mixing apparatus, or by adding a dispersion of the external additive in an aqueous medium (e.g., water or water-alcohol) to a capsule toner slurry, followed by drying.

The present invention is now illustrated in greater detail with reference to Examples, but it should be understood that the present invention is not construed as being limited thereto. All the parts and percents are by weight unless otherwise indicated. Photoreceptors and capsule toners used in Examples and Comparative Examples were prepared as follows.

Preparation of Photoreceptors

Photoreceptor 1

A coating composition consisting of 27 parts of a zirconium coupling agent ("ZC 540" produced by Matsumoto Seiyaku K.K.), 23 parts of n-butyl alcohol, and 45 parts of isopropyl alcohol was dip coated on an aluminum pipe having a diameter of 40 mm and dried at 130° C. for 30 minutes to form a 0.1 μm-thick subbing layer.

A mixture consisting of 60 parts of a titanyl phthalocyanine pigment showing the highest peak at a Bragg angle ($2\theta$) of 27.3°±0.2° C. against $CuK_\alpha$ characteristic X-rays (wavelength: 1.541-A) as a charge generating material, 40 parts of a polyvinyl butyral resin ("S-Lec BM-S" produced by Sekisui Chemical Co., Ltd.), and 150 parts of n-amyl acetate was dispersed in a sand mill for 5 hours. The dispersion was dip coated on the subbing layer and dried at 110° C. for 10 minutes to form a 0.2 μm-thick charge generating layer.

A coating composition consisting of 20 parts of Compound 1 as a high polymeric arylamine compound (average molecular weight: 100,000) and 130 parts of monochlorobenzene was then dip coated on the charge generating layer and dried at 130° C. for 1 hour to form a 22 μm-thick charge transporting layer. The resulting photoreceptor was designated Photoreceptor 1.

Photoreceptor 2

Photoreceptor 2 was prepared in the same manner as for Photoreceptor 1, except for using 12 parts of a polyamide resin ("Rackamide L5003" produced by Toray Industries, Inc.), 60 parts of methyl alcohol, 40 parts of butyl alcohol, and 10 parts of water to form a 1 μm-thick subbing layer; using 7 parts of x-type metal-free phthalocyanine, 3 parts of a polyvinyl butyral resin ("S-Lec BM-3"), and 30 parts of cyclohexanone to form a 0.3 μm-thick charge generating layer; and using 20 parts of Compound 2 (average molecular weight: 100,000) and 130 parts of monochlorobenzene to form a 20 μm-thick charge transporting layer.

Photoreceptor 3

Photoreceptor 3 was prepared in the same manner as for Photoreceptor 1, except for using 27 parts of a silane coupling agent ("A 1100" produced by Nippon Yunika Co., Ltd.), 23 parts of n-butyl alcohol, and 45 parts of isopropyl alcohol to form a 0.3 μm-thick subbing layer; using 10 parts of metal-free phthalocyanine, 5 parts of a vinyl chloride-vinyl acetate-maleic acid copolymer resin ("VMCH" produced by Union Carbide, Inc.), and 300 parts of n-amyl acetate to form a 0.3 μm-thick charge generating layer; and using 20 parts of Compound 3 (average molecular weight: 100,000) and 130 parts of monochlorobenzene to form a 20 μm-thick charge transporting layer.

Photoreceptor 4 (Comparative)

Photoreceptor 4 was prepared in the same manner as for Photoreceptor 1, except for using 4 parts of N,N'-diphenyl-N,N'-bis(3-methylphenyl)-[1,1'-biphenyl]-4,4'-diamine, 6 parts of a bisphenol Z polycarbonate resin (molecular weight: 40,000), and 80 parts of chlorobenzene to form a 24 μm-thick charge transporting layer.

Photoreceptor 5 (Comparative)

Photoreceptor 5 was prepared in the same manner as for Photoreceptor 4, except for replacing the bisphenol Z polycarbonate resin with a bisphenol A type polycarbonate resin (molecular weight: 30,000) and replacing chlorobenzene with tetrahydrofuran to form a 23 μm-thick charge transporting layer.

Preparation of Capsule Toner

Capsule Toner A

Fifty grams of polylauryl methacrylate (molecular weight: $5\times10^4$) and 15 g of a petroleum resin ("FTR 6125" produced by Mitsui Petrochemical Industries, Ltd.) were dissolved in a mixed solvent of 25 g of an aliphatic saturated hydrocarbon solvent ("Isopar H" produced by EXXON CHEMICAL CO., LTD) and 30 g of ethyl acetate. To the solution was added 55 g of a magnetic powder ("EPT-1000" produced by Toda Kogyo K.K.), and the mixture was dispersed in a ball mill for 20 hours. To 100 g of the dispersion were added 15 g of an isocyanate compound ("Sumidul L" produced by Sumitomo Bayer Urethane Co., Ltd.) and 15 g of ethyl acetate, followed by thoroughly mixing. The resulting liquid was designated Liquid A.

Separately, 10 g of hydroxypropylmethyl cellulose ("Metholose 65H50" produced by Shin-Etsu Chemical Industry Co., Ltd.) was dissolved in 200 g of deionized water, and the solution was kept at 5° C. The resulting liquid was designated Liquid B.

Liquid B was stirred in an emulsifier ("Auto Homomixer" produced by Tokushu Kako K.K.), and Liquid A was slowly poured therein to conduct emulsification. There was obtained an oil-in-water emulsion of oil droplets having an average particle size of about 12 μm.

The resulting emulsion was further stirred in a propeller mixer ("Three-One Motor" produced by Shinto Kagaku K.K.) at 400 rpm. Ten minutes later, 100 g of a 5% diethylenetriamine aqueous solution was added thereto dropwise. After the addition, the mixture was heated to 60° C. to conduct an encapsulation reaction for 3 hours while driving ethyl acetate out of the system. After completion of the reaction, the reaction mixture was poured into 2 l of deionized water, and the mixture was thoroughly stirred and then allowed to stand still. After capsule particles sedimented, the supernatant liquor was removed. The above-described operation of washing with water was repeated 7 more times. Finally, deionized water was added to the capsule particles to prepare a suspension having a solid content of 40%.

To 125 g of the resulting capsule suspension (solid content: 50 g) was added 125 g of deionized water, followed by stirring in a propeller mixer ("Three-One Motor") at 200 rpm. To the mixture were added 5 g of 1N nitric acid and 4 g of a 10% cerium sulfate aqueous solution and was then further added 0.5 g of ethylene glycol dimethacrylate, followed by allowing the mixture to react at 15° C. for 3 hours. After completion of the reaction, the reaction mixture was poured into 1 l of deionized water, followed by thoroughly stirring and then allowing to stand still. After sedimentation of the capsule particles, the supernatant liquor was removed. This operation of water washing was repeated two more times to obtain capsule particles having ethylene glycol dimethacrylate graft-polymerized on the surface of the outer shell thereof.

The resulting capsule particles were re-suspended in deionized water and stirred in a propeller mixer ("three-One Motor") at 200 rpm. To the suspension were successively added 0.4 g of potassium persulfate, 1 g of trifluoroethyl methacrylate, and 0.16 g of sodium hydrogensulfite, followed by allowing the mixture to react at 25° C. for 3 hours. After completion of the reaction, the reaction mixture was poured into 2 l of deionized water, thoroughly stirred, and allowed to stand. After sedimentation of the capsule particles, the supernatant liquor was removed. This operation of water washing was repeated 4 more times to obtain capsule particles having trifluoroethyl methacrylate graft-polymerized on the surface of the outer shell thereof.

The resulting capsule slurry was spread on a stainless steel-made tray and dried in a drier (produced by Yamato Kagaku K.K.) at 60° C. for 10 hours. The resulting toner was thoroughly mixed with 0.7 part of hydrophobic silica ("R 972" produced by Nippon Aerosil Co., Ltd.) per 100 parts of the toner to obtain a negatively chargeable capsule toner. The resulting capsule toner was designated Capsule Toner A.

Capsule Toner B

Fifty grams of polylauryl methacrylate (molecular weight: $5\times10^4$) and 30 g of polyisobutyl methacrylate (molecular weight: $16\times10^4$) were dissolved in a mixed solvent of 10 g of dibutyl phthalate, 40 g of "Isopar H", and 40 g of ethyl acetate. To the solution was added 120 g of a magnetic powder ("EPT-1000") and the mixture was dispersed in a ball mill for 16 hours. To 200 g of the dispersion were added 30 g of an isocyanate compound "Sumidul L" and 24 g of ethyl acetate, followed by thoroughly mixing. The resulting liquid was designated Liquid A'.

Separately, 10 g of hydroxypropylmethyl cellulose ("Metholose 65H50") was dissolved in 200 g of deionized water, and the solution was kept at 5° C. The resulting liquid was designated Liquid B'.

Liquid B' was stirred in an emulsifier ("Auto Homomixer"), and Liquid A' was slowly poured therein to conduct emulsification. There was obtained an oil-in-water emulsion of oil droplets having an average particle size of about 12 μm.

The resulting emulsion was further stirred in a propeller mixer ("Three-One Motor") at 400 rpm. Ten minutes later, 100 g of a 5% diethylenetriamine aqueous solution was added thereto dropwise. After the addition, the mixture was heated to 60° C. to conduct an encapsulation reaction for 3 hours. After completion of the reaction, the reaction mixture was poured into 2 l of deionized water, and the mixture was thoroughly stirred and then allowed to stand still. After capsule particles sedimented, the supernatant liquor was removed. The above-described operation of washing with water was repeated 7 more times. Finally, deionized water was added to the capsule particles to prepare a suspension having a solid content of 40%.

To 125 g of the resulting capsule suspension (solid content: 50 g) was added 125 g of deionized water, followed by stirring in a propeller mixer ("Three-One Motor") at 200 rpm. To the mixture were added 5 g of 1N nitric acid and 4 g of a 10% cerium sulfate aqueous solution and was then further added 0.5 g of ethylene glycol dimethacrylate, followed by allowing the mixture to react at 15° C. for 3 hours. After completion of the reaction, the reaction mixture was poured into 1 l of deionized water, followed by thoroughly stirring and then allowing to stand still. After sedimentation of the capsule particles, the supernatant liquor was removed. This operation of water washing was repeated two more times to obtain capsule particles having ethylene glycol dimethacrylate graft-polymerized on the surface of the outer shell thereof.

The resulting capsule particles were re-suspended in deionized water and stirred in a propeller mixer ("three-One Motor") at 200 rpm. To the suspension were successively added 0.4 g of potassium persulfate, 0.2 g of N-cetylvinylpyridinium chloride, 2.0 g of methyl methacrylate, and 0.16 g of sodium hydrogensulfite, followed by allowing the mixture to react at 25° C. for 3 hours. After completion of the reaction, the reaction mixture was poured into 2 l of deionized water, thoroughly stirred, and allowed to stand. After sedimentation of the capsule particles, the supernatant liquor was removed. This operation of water washing was repeated 4 more times. To the capsule suspension was added 2 g of a 5% aqueous solution of sodium 1-naphthalenesulfonate, followed by stirring at room temperature for 30 minutes to conduct ion-exchanging. After the reaction, the capsule particles were washed 5 times with 1 l portions of deionized water.

The resulting capsule slurry was spread on a stainless steel-made tray and dried in a drier (produced by Yamato Kagaku K.K.) at 60° C. for 10 hours to obtain a positively chargeable capsule toner. The resulting capsule toner was designated Capsule Toner B.

EXAMPLE 1

Each of Photoreceptors 1 to 5 was fitted into a laser beam printer ("FX-4105" manufactured by Fuji Xerox Co., Ltd.; remodeled by setting the contact blade pressure of the developing part at 10 g/cm and displacing the fixing part with a pressure fixing part (fixing pressure set at 200 kg/cm$^2$)), and Capsule Toner A was loaded in the developing part. A printing test of obtaining 20,000 copies was carried on, and the resulting copies were evaluated and rated "good" (no image disappearance occurred) or "bad" (image disappearance occurred). The rating results are shown in Table 1 below. It is seen from Table 1 that image disappearance occurred when in using Photoreceptor 4 or 5.

TABLE 1

| | 1000 Copies | 2000 Copies | 5000 Copies | 10000 Copies | 20000 Copies |
|---|---|---|---|---|---|
| Photoreceptor 1 | good | good | good | good | good |
| Photoreceptor 2 | good | good | good | good | good |
| Photoreceptor 3 | good | good | good | good | good |
| Photoreceptor 4 | good | good | bad | bad | bad |
| Photoreceptor 5 | bad | bad | bad | bad | bad |

EXAMPLE 2

The same printing test as in Example 1 was carried on, except for using Capsule Toner B and further applying the following modifications to the laser beam printer "FX-410": i.e., the laser writing was effected on the non-image area, and the transfer polarity was minus. The results of the test are shown in Table 2 below.

TABLE 2

| | 1000 Copies | 2000 Copies | 5000 Copies | 10000 Copies | 20000 Copies |
|---|---|---|---|---|---|
| Photoreceptor 1 | good | good | good | good | good |
| Photoreceptor 2 | good | good | good | good | good |
| Photoreceptor 3 | good | good | good | good | good |
| Photoreceptor 4 | good | bad | bad | bad | bad |
| Photoreceptor 5 | bad | bad | bad | bad | bad |

As described above, according to the image formation method of the present invention which is characterized by using the high polymeric compound of formula (I) as a charge transporting material and a microcapsule toner as a developer, copies of satisfactory image quality can be obtained in a stable manner for an extended period of time without being accompanied by the phenomenon of copy image disappearance which has conventionally occurred in long-term copying using a microcapsule toner.

While the invention has been described in detail and with reference to specific examples thereof, it will be apparent to one skilled in the art that various changes and modifications can be made therein without departing from the spirit and scope thereof.

What is claimed is:

1. An electrophotographic method for image formation comprising forming an electrostatic latent image on an electrophotographic photoreceptor comprising a conductive substrate having formed thereover a photosensitive layer containing a charge transporting material comprising a high polymeric arylamine compound represented by formula (I):

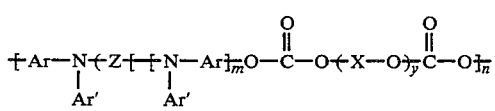

(I)

wherein n represents n integer of from 5 to 5000; m represents 0 or 1; y represents 1, 2, or 3; Ar represents

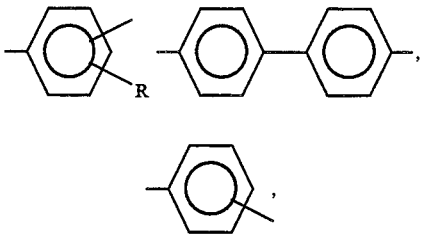

wherein R represents a methyl group, an ethyl group, a propyl group, or a butyl group; Ar′ represents

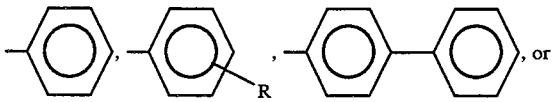

-continued

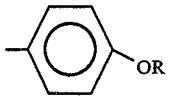

wherein R is as defined above; X represents an alkylene or isoalkylene group having from 2 to 10 carbon atoms; and z represents

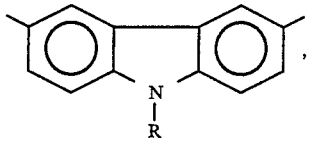

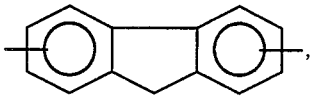

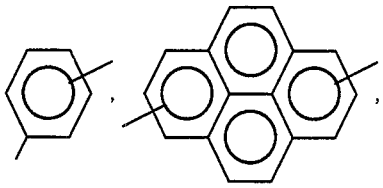

or —Ar—(W)$_k$—Ar—, wherein Ar is as defined above; W represents —$CH_2$—, —$C(CH_3)_2$—, —O—, —S—,

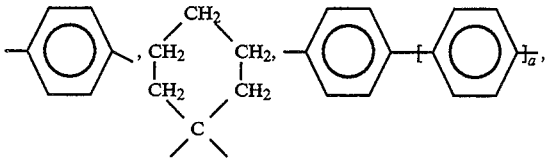

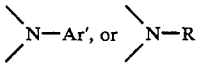

(wherein s represents 0, 1, or 2; and R and Ar′ are as defined above); and k represents 0 or 1, developing the latent image with a microcapsule toner containing in its core at least a polymer dispersed in a solvent and containing on its shell a charge control agent, and transferring the toner image to paper.

2. An electrophotographic method for image formation as claimed in claim 1, wherein said microcapsule toner has a capsule structure composed of a core material and an outer shell material covering the core material, said core material contains at least a poller and a colorant dispersed in a solvent, said outer shell material comprising a polyurea resin and/or a polyurethane resin, or an epoxyurea resin and/or an epoxyurethane resin, said outer shell having on the surface thereof a charge control agent, and said capsule toner having added thereto an external additive.

3. An electrophotographic method for image formation as claimed in claim 1, wherein said solvent in the microcapsule toner is a paraffinic hydrocarbon, a fatty acid ester, or a mixture thereof.

4. An electrophotographic method for image formation as claimed in claim 1, wherein said charge transporting material forms a surface layer .of the photoreceptor.

* * * * *